US007640927B1

(12) United States Patent
Broersma

(10) Patent No.: US 7,640,927 B1
(45) Date of Patent: Jan. 5, 2010

(54) MULTIPLE FUNCTION PAINTBALL MARKER BOLT

(76) Inventor: Lester Broersma, 2050 Camino De La Reina, #214, San Diego, CA (US) 92108

( * ) Notice: Subject to any disclaimer, the term of this patent is extended or adjusted under 35 U.S.C. 154(b) by 69 days.

(21) Appl. No.: 12/154,281

(22) Filed: May 21, 2008

Related U.S. Application Data

(63) Continuation-in-part of application No. 11/233,520, filed on Sep. 22, 2005, now abandoned.

(51) Int. Cl.
*F41B 11/00* (2006.01)

(52) U.S. Cl. ..... 124/80; 124/73

(58) Field of Classification Search ..... 124/73, 124/80
See application file for complete search history.

(56) References Cited

U.S. PATENT DOCUMENTS

| | | | | | |
|---|---|---|---|---|---|
| 645,932 | A | | 3/1900 | Ferrant | 89/125 |
| 1,167,178 | A | | 1/1916 | Hill | 124/56 |
| 1,343,127 | A | | 6/1920 | Hallinan | 124/54 |
| 1,743,576 | A | | 1/1930 | Smith | 124/72 |
| 2,550,887 | A | | 5/1951 | Tratsch | 124/1 |
| 2,568,432 | A | | 9/1951 | Cook | 124/13 |
| 2,834,332 | A | | 5/1958 | Guthrie | 124/13 |
| 2,845,055 | A | | 7/1958 | Collins et al. | 124/11 |
| 3,089,476 | A | | 5/1963 | Wolverton | 124/11 |
| 3,204,625 | A | * | 9/1965 | Shepherd | 124/74 |
| 3,240,200 | A | | 3/1966 | Jones | 124/11 |
| 3,273,553 | A | | 9/1966 | Doyle | 124/3 |
| 3,374,708 | A | | 3/1968 | Wall et al. | 89/1 |
| 3,494,344 | A | | 2/1970 | Vadas et al. | 124/11 |
| 3,548,708 | A | | 12/1970 | Hubigh | 89/1.818 |
| 3,572,310 | A | | 3/1971 | Kensuke | 124/11 |
| 3,645,165 | A | * | 2/1972 | Wohlford | 89/11 |
| 3,695,246 | A | | 10/1972 | Filippi et al. | 124/11 |
| 3,818,887 | A | | 6/1974 | Akiyama et al. | 124/15 |
| 3,899,845 | A | | 8/1975 | Wild et al. | 42/69 |
| 3,923,033 | A | | 12/1975 | Laporte et al. | 124/8 |
| 4,066,000 | A | | 1/1978 | Rostocil | 89/198 |
| 4,347,679 | A | | 9/1982 | Grunig et al. | 42/84 |
| 4,362,145 | A | | 12/1982 | Stelcher | 124/32 |
| 4,602,608 | A | | 7/1986 | Lacam et al. | 124/74 |
| 4,679,487 | A | | 7/1987 | Houseman | 89/140 |
| 4,694,815 | A | | 9/1987 | Hung | 124/27 |
| 4,770,153 | A | | 9/1988 | Edelman | 124/72 |
| 4,779,245 | A | | 10/1988 | Chelminski | 367/144 |
| 4,819,609 | A | | 4/1989 | Tippmann | 124/72 |
| 4,833,970 | A | * | 5/1989 | Wilhelm | 89/141 |
| 4,899,717 | A | | 2/1990 | Rutten et al. | 124/67 |
| 4,936,282 | A | | 6/1990 | Dobbins et al. | 124/74 |
| 5,063,905 | A | | 11/1991 | Farrell | 124/72 |
| 5,078,118 | A | | 1/1992 | Perrone | 124/74 |
| 5,149,898 | A | | 9/1992 | Chesnut et al. | 42/69.01 |
| 5,228,427 | A | | 7/1993 | Gardner, Jr. | 124/71 |
| 5,257,614 | A | * | 11/1993 | Sullivan | 124/73 |

(Continued)

*Primary Examiner*—Troy Chambers
(74) *Attorney, Agent, or Firm*—Keisling Pieper & Scott, PLC; David B. Pieper

(57) ABSTRACT

A paintball marker using a lightweight bolt design suing a composite bolt structure with a light weight body and precision sear release edge adapted for consistent sear over the life of the marker. The composite bolt structure also has a spring retention end with a sear access slot and sear retraction ramp for guiding the sear to the precision release edge.

4 Claims, 6 Drawing Sheets

U.S. PATENT DOCUMENTS 5,261,384 A 11/1993 Hu ..... 124/66
5,280,778 A 1/1994 Kotsiopoulos ..... 124/73
5,339,791 A * 8/1994 Sullivan ..... 124/73
5,349,938 A * 9/1994 Farrell ..... 124/73
5,349,939 A 9/1994 Perrone ..... 124/76
5,363,834 A 11/1994 Stuchlik ..... 124/76
5,462,042 A 10/1995 Grenwell ..... 124/76
5,503,137 A 4/1996 Fusco ..... 124/72
5,505,188 A * 4/1996 Williams ..... 124/74
5,542,406 A * 8/1996 Oneto ..... 124/73
5,613,483 A 3/1997 Lukas et al. ..... 124/73
5,634,456 A 6/1997 Perrone ..... 124/76
5,727,538 A 3/1998 Ellis ..... 124/77
5,771,875 A * 6/1998 Sullivan ..... 124/72
5,878,736 A 3/1999 Lotuaco, III ..... 124/71
5,881,707 A 3/1999 Gardner, Jr. ..... 124/77
5,913,303 A 6/1999 Kotsiopoulos ..... 124/31
5,967,133 A 10/1999 Gardner, Jr. ..... 124/77
6,003,504 A 12/1999 Rice et al. ..... 124/73
6,035,843 A 3/2000 Smith et al. ..... 124/77
6,048,280 A 4/2000 Palmer et al. ..... 473/416
6,065,460 A 5/2000 Lotuaco, III ..... 124/72
6,138,656 A 10/2000 Rice et al. ..... 124/73
6,142,136 A * 11/2000 Velasco ..... 124/71
6,311,682 B1 11/2001 Rice et al. ..... 124/71
6,349,711 B1 2/2002 Perry et al. ..... 124/73
6,439,217 B1 8/2002 Shih ..... 124/77
6,474,326 B1 11/2002 Smith et al. ..... 124/77
6,494,194 B2 12/2002 Shipachev et al. ..... 124/73
6,532,949 B1 3/2003 McKendrick ..... 124/77
6,550,468 B1 4/2003 Tippmann, Jr. ..... 124/71
6,553,983 B1 4/2003 Li ..... 124/73
6,578,566 B2 6/2003 Hernandez ..... 124/73
6,590,386 B1 7/2003 Williams ..... 324/178
6,615,814 B1 9/2003 Rice et al. ..... 124/71
6,626,165 B1 9/2003 Bhogal ..... 124/77
6,637,420 B2 10/2003 Moritz ..... 124/73
6,637,421 B2 10/2003 Smith et al. ..... 124/77
6,644,295 B2 11/2003 Jones ..... 124/77
6,644,296 B2 11/2003 Gardner, Jr. ..... 124/77
6,658,982 B2 12/2003 Cherry ..... 89/1.42
6,694,963 B1 2/2004 Taylor ..... 124/32
6,705,036 B2 3/2004 Orr ..... 42/69.01
6,748,938 B2 6/2004 Rice et al. ..... 124/77
6,763,822 B1 7/2004 Styles ..... 124/77
7,121,271 B1 * 10/2006 Arndt ..... 124/71
2003/0131514 A1 7/2003 Rice et al. ..... 42/69.01
2003/0131834 A1 7/2003 Rice et al. ..... 124/32
2003/0154968 A1 8/2003 Rice et al. ..... 124/71
2003/0178018 A1 9/2003 Cherry ..... 124/76
2003/0221684 A1 12/2003 Rice ..... 124/71
2004/0011344 A1 1/2004 Rice et al. ..... 124/73
2004/0084040 A1 5/2004 Jones ..... 124/77
2006/0027224 A1 * 2/2006 Lin ..... 124/70
2006/0207587 A1 * 9/2006 Jones et al. ..... 124/74

* cited by examiner

MULTIPLE FUNCTION PAINTBALL MARKER BOLT

CROSS-REFERENCE TO RELATED APPLICATIONS

This application claims priority to and is a continuation-in-part of U.S. application Ser. No. 11/233,520, filed Sep. 22, 2005 now abandoned.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of paintball markers. In particular, the present invention relates specifically to paintball markers using gas provided by a gas canister. Known art may be found in U.S. Class 124 Mechanical Guns and Projectors: Subclass 53 Having Cut-Off, Subclass 63 Provided by Movement of User-Actuated, Projector-Mounted Pressure Member, Subclass 73 By Valve Means; Class 141 Fluent Material Handling, with Receiver or Receiver Contacting Means: Subclass 290 With Flue or Vent Externally Returning to Supply as well as in other classes and subclasses.

2. Description of the Known Art

As will be appreciated by those skilled in the art, gas cartridges have been used to supply gas to paintball markers. Patents and Applications disclosing information regarding various canister or marker configurations include U.S. Patent Publication No. 2003/0131834, issued to Rice on Jul. 17, 2003; U.S. Patent Publication No. 2003/0178018, issued to Cherry on Sep. 25, 2003; U.S. Patent Publication No. 2004/0144012, issued to Adams on Jul. 29, 2004; U.S. Pat. No. 1,743,576, issued to Smith on Jul. 14, 1927; U.S. Pat. No. 3,494,344, issued to Vadas on Feb. 10, 1970; U.S. Pat. No. 4,362,145, issued to Stelcher on Dec. 7, 1982; U.S. Pat. No. 4,819,609, issued to Tippmann on Apr. 11, 1989; U.S. Pat. No. 5,634,456, issued to Perrone on Jun. 3, 1997; U.S. Pat. No. 5,839,422, issued to Ferris on Nov. 24, 1998; and U.S. Pat. No. 6,494,194, issued to Shipachev on Dec. 17, 2002. Each of these patents and publications are hereby expressly incorporated by reference in their entirety.

This prior art shows the desire to use a gas cartridge because a filled cartridge may be shipped within the department of transportation guidelines. However, the prior art fails to teach the limitations imposed by these cartridges and how to overcome these limitations. Thus, it may be seen that these prior art patents are very limited in their teaching and utilization, and an improved marker is needed to overcome these limitations.

SUMMARY OF THE INVENTION

The present invention is directed to an improved paintball marker having an increased gas supply through a sealing and piercing connection with multiple gas canisters. In accordance with one exemplary embodiment of the present invention, a paintball marker is provided using a pressurized gas supplied from a plurality of gas cartridges. Each of the gas cartridges has a gas containment body that needs to be pierced to release the pressurized gas. The inventive aspect of the marker uses a plurality of gas inputs to connect to multiple gas cartridges. The marker uses a unique construction such that each of the multiple gas inputs is sealably connectable to one gas cartridge and then a piercing needle is used to puncture the sealed gas cartridge. The gas is then directed by the needle and the input to a common chamber. In this manner, the gas inputs are fluidly connected to a gas combination chamber. This combined gas flow is then used to launch paintballs. As noted by this invention, one inventive aspect of the invention is provided by a pressure application device which applies the sealing pressure to the gas cartridges and then applies the piercing pressure to the gas cartridges.

A method is also taught that uses the elements of providing multiple inputs for accepting the pressurized gas from each of gas cartridges; releasing the pressurized gas from the cartridges; combining at least a portion of the pressurized gas from each of the gas cartridges to form a combined gas supply; and selectively releasing the combined gas supply to act on the paintball. Other elements that may be included in this method include sealing at least a portion of the multiple gas cartridges and then piercing the sealed portion of a plurality of the multiple gas cartridges to release the pressurized gas; providing a piercing needle and pressing the gas cartridge against the piercing needle; or providing a gas expansion chamber and using a combined volume chamber to provide a launching volume of gas.

One object of the present invention is to provide an increased gas supply by combining multiple cartridge supplies while still providing a single valve assembly that is easily and inexpensively controlled.

A further object of the invention is a method for sealing and piercing multiple cartridges without prematurely releasing gas from one of the canisters.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
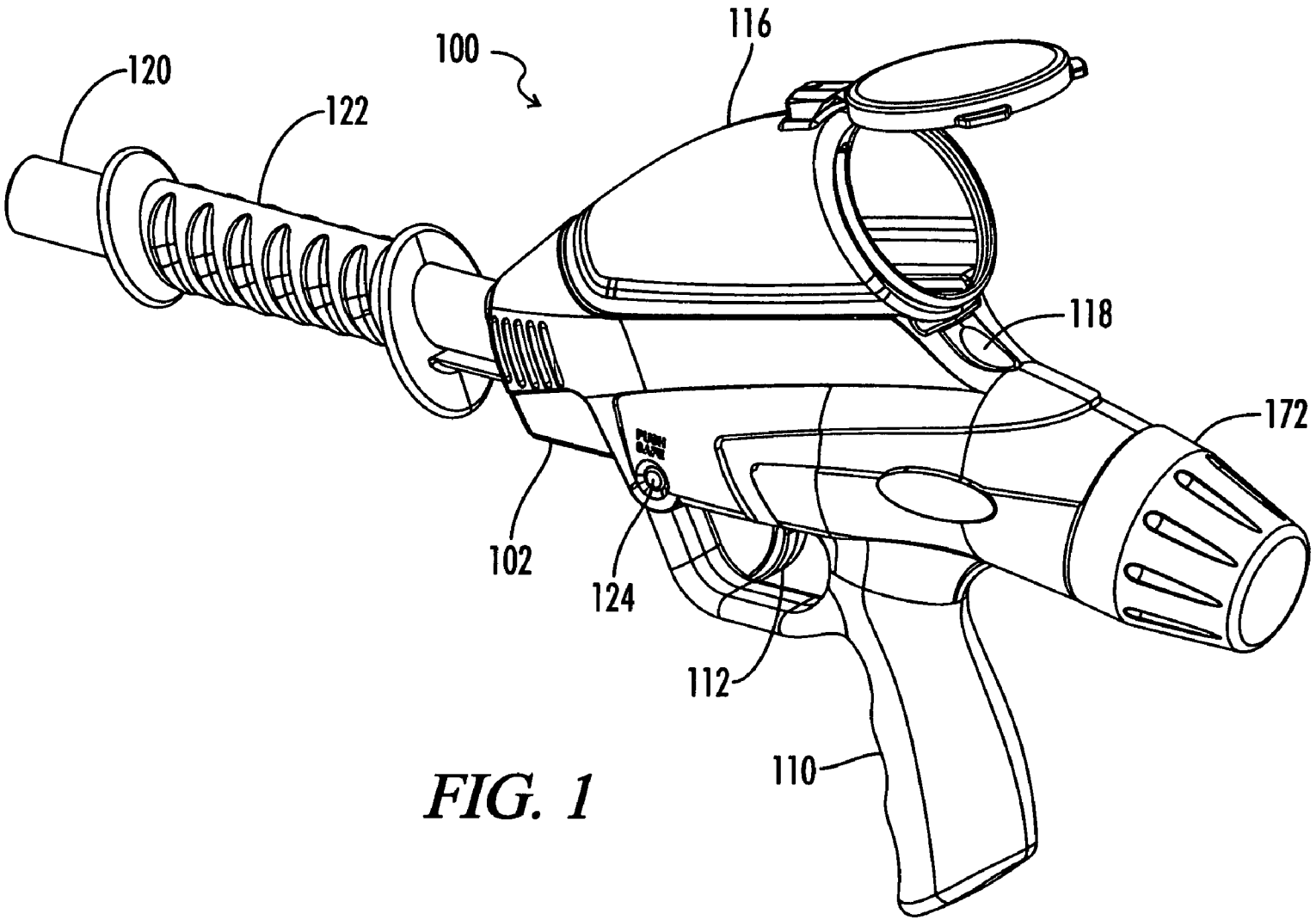
FIG. 1 is an isometric view of a paintball marker.

As shown in FIGS. 1 through 15 of the drawings, one exemplary embodiment of the present invention is generally shown as a multiple canister supply paintball marker 100 for using pressurized gas 22 for launching a paintball 10. The gas is provided in commercially known and available gas cartridges 20 shown in FIGS. 2 through 6 that hold a pressurized gas 22 within a gas containment body 24. The gas cartridges 20 are also known as gas containers 20. The pressurized gas 22 may be seen in its initial position within the gas container 20 through the cutaway section of the gas containment body 24 shown in FIG. 3. The gas containment body includes a release neck 26, an elongated central compartment 28 and a domed end 30. The gas cartridges 20 are designed so that they will release the pressurized gas 22 upon puncturing of the release neck 26. The release neck 26 is flowably connected to the elongated central compartment 28 which is capped by the domed end 30 of the cartridge 20.

FIG. 1 shows an external overview of the multiple canister paintball marker 100 having a marker body 102. Extending downward from the marker body 102 is the grip 110 which houses the trigger 112. The safety 124 interacts with the trigger 112 to selectively lock the marker 100 in an inoperable condition. On top of the marker body 102 is mounted the hopper 116 which is selectively attached and released by the hopper release button 118. Extending from the front of the marker body 102 is the barrel 120 and the cocking pump handle 122. The back of the marker body 102 is covered by the piercing screw cartridge cap 172. This is the area where the multiple gas cartridges 20 are mounted in, sealed to, and pierced by the marker 100.

Figure 2:
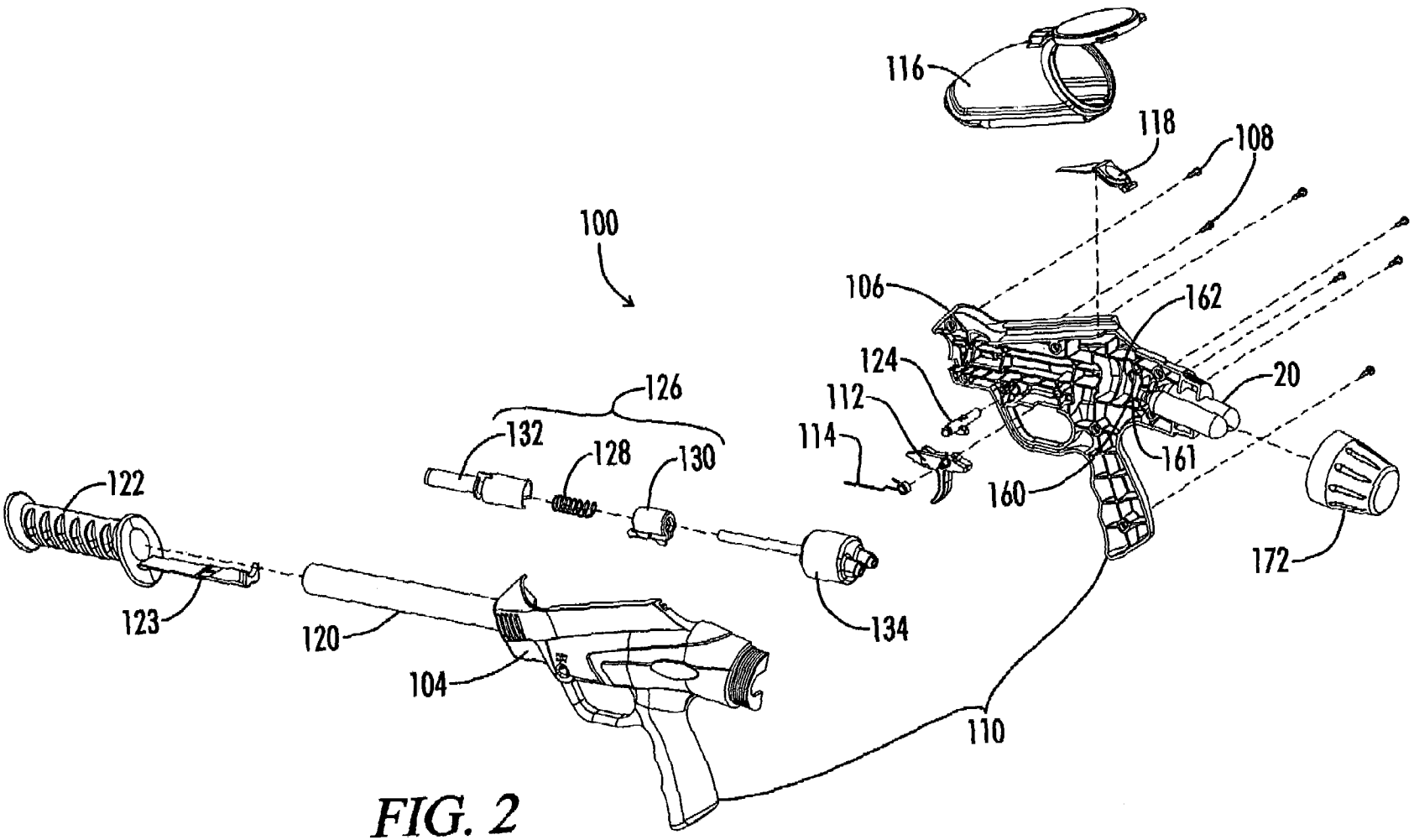
FIG. 2 is an exploded view of the paintball marker of FIG. 1.
Figure 3:
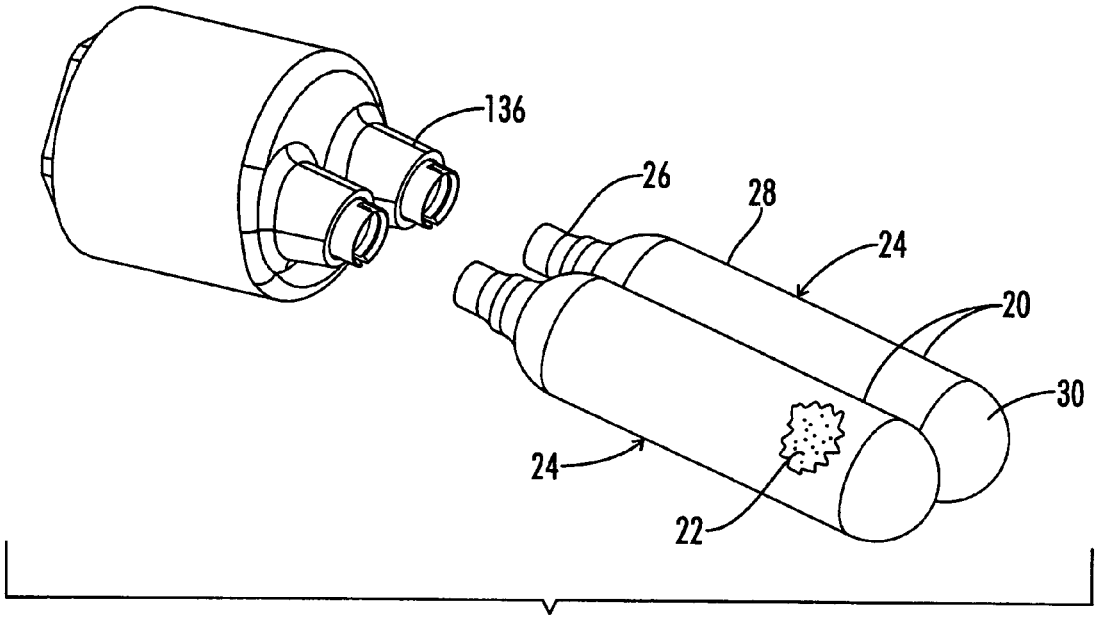
FIG. 3 is a schematic view of the multiple cartridges and combination chamber arrangement before connection.
Figure 4:
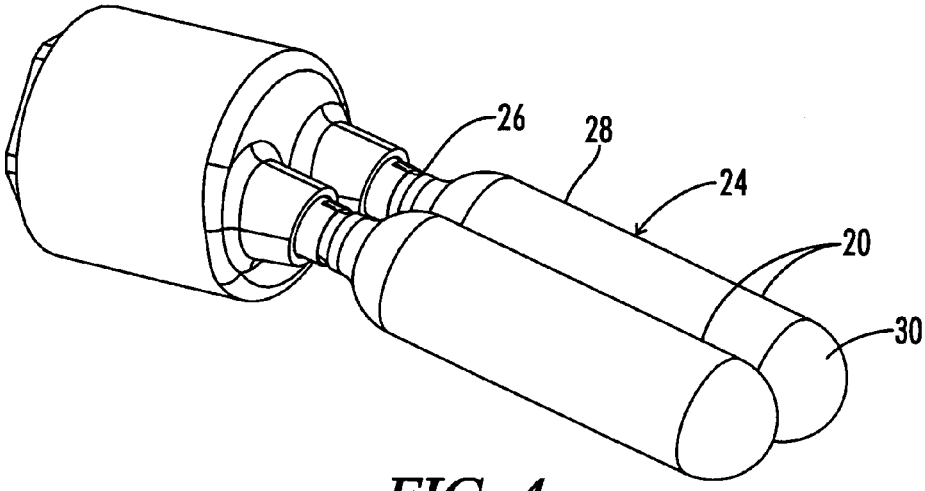
FIG. 4 is a schematic view of the connected arrangement for the multiple cartridges and combination chamber.

FIG. 2 of the drawings shows an exploded view of the multiple cartridge apparatus 100. This figure shows how the cartridges 20 are mounted into a fixed position in the marker body 102 such that the piercing cap 172 can apply the sealing pressure and the piercing pressure to release the gas into the marker 100. The marker body 102 is made up of a left housing 104 and a right housing 106 which are connected together by screws 108. As shown in FIG. 2, the grip 110 is molded as an integral part of the marker body 102. The trigger 112 pivots within a cavity in the housings 104, 106 and is biased by a trigger spring 114 to engage the hammer assembly 130. The hopper 116 slides into the housings 104, 106 and is releasably held in place by the hopper release button 118. The back of the hopper release button 118 is designed with a pivot axis and the front of the hopper release button 118 slides in the housings 104, 106 such that the release button 118 downwardly flexes to provide the necessary movement for releasing the hopper 116. The barrel 120 is molded into the left housing 104 to provide a smooth barrel without a molding separation line. The cocking pump handle 122 slides over the barrel and uses an extended arm 123 to connect with the bolt assembly 132 for cocking the marker 100. The safety 124 slides sideways in the housings 104, 106 to selectively block the movement of the trigger 112.

Figure 5:
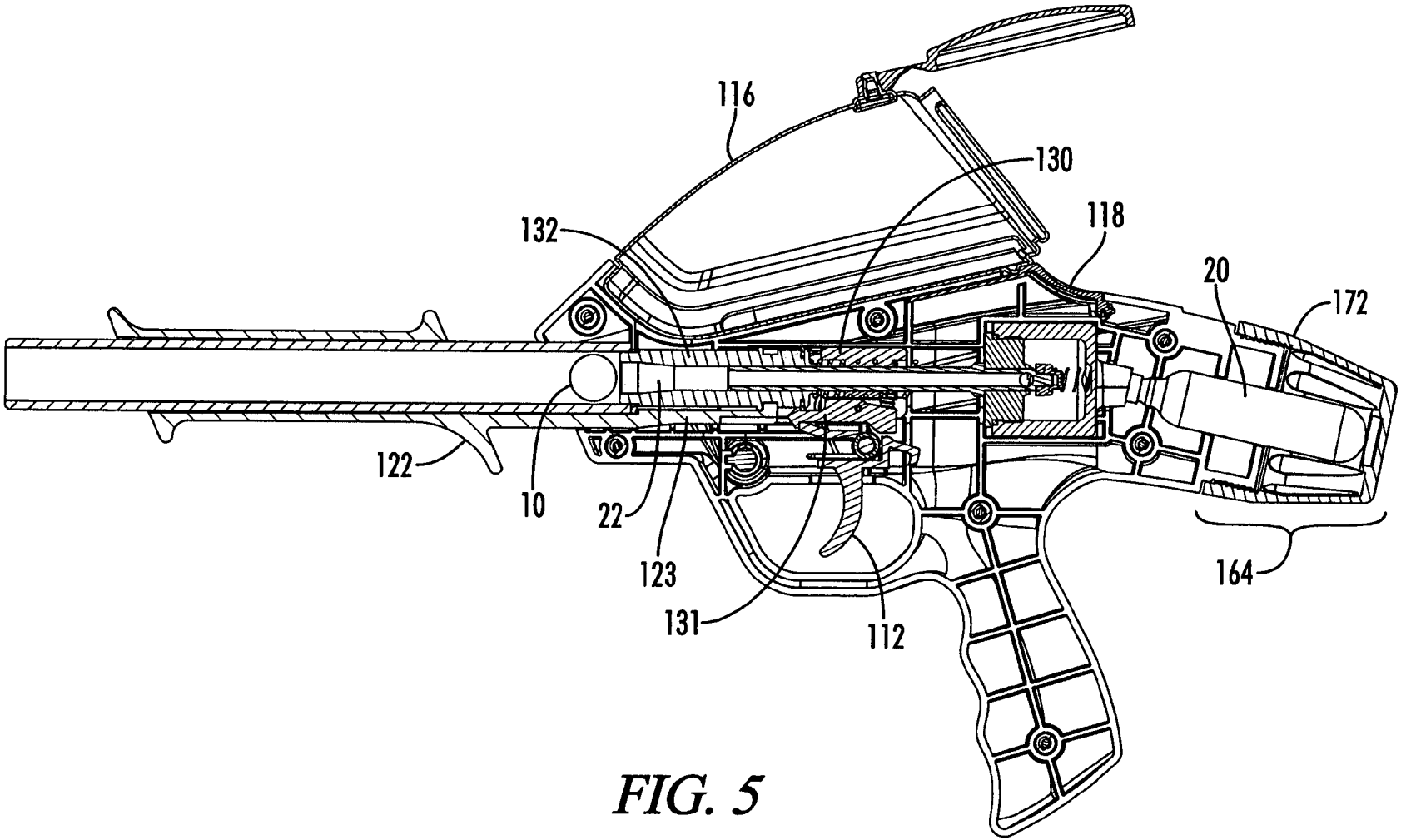
FIG. 5 is a cut away schematic view of the paintball marker of FIG. 1.
Figure 6:
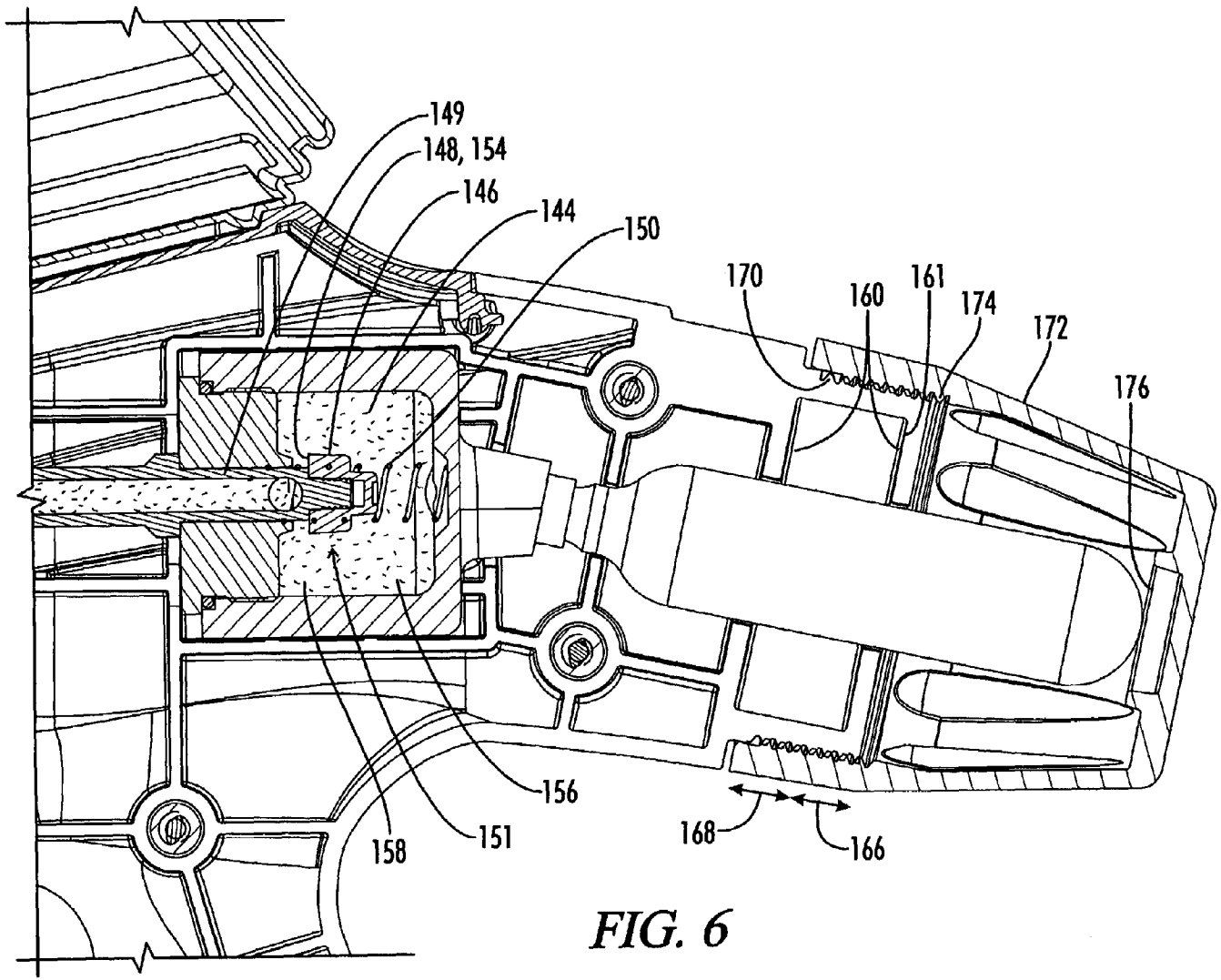
FIG. 6 is an exploded view of the combination chamber area of FIG. 5.
Figure 7:
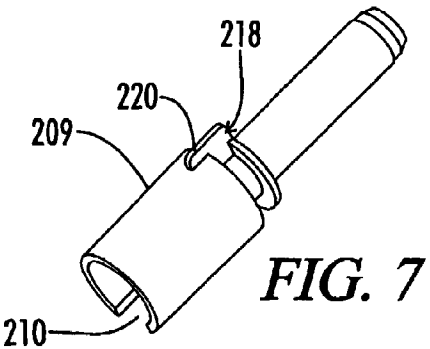
FIG. 7 is a top isometric view of the breech bolt of the present invention.
Figure 8:
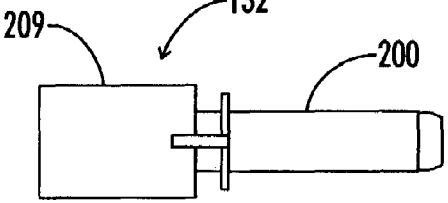
FIG. 8 is a top view of the breech bolt of the present invention.
Figure 10:
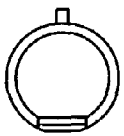
FIG. 10 is a back view of the breech bolt of the present invention.
Figure 11:
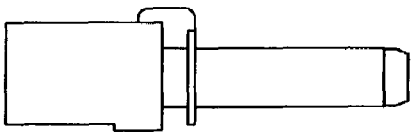
FIG. 11 is a right side view of the breech bolt of the present invention.
Figure 12:
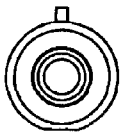
FIG. 12 is a back view of the breech bolt of the present invention.
Figure 9:
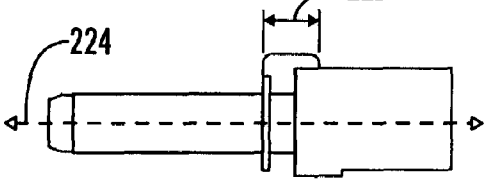
FIG. 9 is a right side view of the breech bolt of the present invention.
Figure 15:
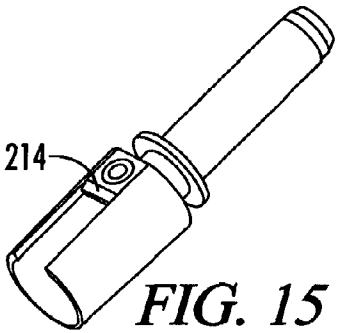
FIG. 15 is a bottom isometric view of the breech bolt of the present invention.

The launching device 126 includes a hammer compression spring 128 mounted between a hammer assembly 130 and a-bolt assembly 132. In the basic operation of the marker 100, the extension 123 of the cocking pump handle 122 engages the bolt assembly 132 and is pushed back until the hammer release 131 engages the bolt assembly 132. This rearward movement of the bolt assembly 132 also allows a paintball (not shown in this Figure) to drop from the hopper into the breech area. The cocking pump handle 122 is then moved forward which moves the paintball 10 into the firing position and carries the compressed spring 128 and hammer assembly 130 forward with the cocking pump handle 122. The firing position of the paintball is shown in FIG. 5. The hammer release 131 then engages the trigger 112 and the marker 100 is ready to fire. Pulling the trigger 112 releases the hammer assembly 130 such that the energy of the compressed spring 128 moves the hammer backwards to contact and open the pressure release valve in the valve body assembly 134 to allow the pressurized gas to launch the paintball 10.

Figure 14:
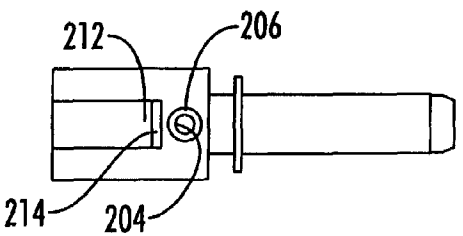
FIG. 14 is a bottom view of the breech bolt of the present invention.
Figure 13:
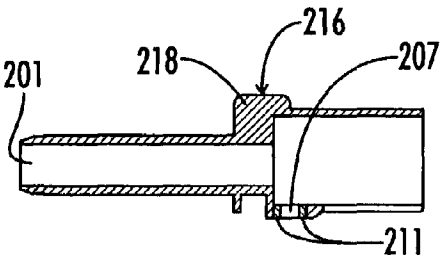
FIG. 13 is a cutaway view of the breech bolt along line A-A shown in FIG. 10.

As shown in FIGS. 3 through 19, the valve body assembly 134 provides a unique combination of elements to allow for multiple cartridges 20 to be used to supply the pressurized gas 22. While any number of multiple inputs could be utilized, the preferred embodiment uses two gas inputs 136. As shown in the sealing and then piercing of FIGS. 16 through 19, each gas input 136 includes a gas seal mounted to seal the cartridge to the gas flow structure. The gas seal is a compression seal that is adapted to seal the gas flow structure to the gas cartridge 20 before puncturing of the cartridge 20 to release the pressurized gas 22. The cartridge 20 is shown in FIG. 16 before insertion into the gas input 136. FIG. 17 then shows the cartridge 20 contacting the seal, and FIG. 18 shows the cartridge 20 compacting the seal to seal the cartridge to the gas input 136. FIG. 19 then shows the needle piercing the cartridge 20 to release the gas 22. The present invention uses a hollow piercing needle to puncture the cartridge 20 and the hollow center body of the needle provides the gas flow structure. The released pressurized gas 22 is guided to the gas combination chamber 144. The gas combination chamber 144 and its expansion volume 156 are shown in FIG. 14. Because the pressurized gas may be in liquid form, the gas combination chamber 144 is designed not only to mix the multiple gas flows together to form a combined gas supply 158, but also provides an expansion volume 156 to allow for the gas to expand to become a more viscous gaseous flow.

A releasable chamber seal 154 is formed in one end of the chamber 144 that allows for selectively releasing the combined gas supply 158. This chamber seal 154 is formed as a pressure release valve that is mounted to the hammer end of the gas combination chamber 144. The pressure release valve has a valve seal 148 that is biased into a sealed position by the seal biasing spring 150. In this manner, the hammer may impact the seal driving rod 149 to move the valve seal backwards to a released position 151 to release the combined pressurized gas supply 158. The seal biasing spring 150 then returns the valve seal 148 to the sealed position.

An important aspect of the present embodiment is the alignment and pressure sealing of all of the canisters 20 into one of the inputs 136 before piercing of any of the canisters 20. As shown in FIGS. 2 and 5 of the drawings, the present invention utilizes a cartridge housing 160 with ribs 161 guiding the canisters 20 into position within a multiple cartridge holding area 162. A pressure application device 164 is then used with a first range of motion 166 to seal the canisters 20 and a second range of motion 168 for piercing the canisters. The preferred embodiment uses a first thread 170 on a piercing screw cartridge cap 172 that engages a second thread 174 on the body 110 of the marker 100. The piercing cap 172 has a circular interior area forming a multiple cartridge contact area 176 which slideably engages the domed end 30 of the cartridges 20 to apply the necessary compression pressure to first seal and then pierce the cartridges 20. Thus, the cartridges 20 are put into the housing 160 and then the piercing cap 172 is screwed onto the marker body 110. As the cap is tightened, the length of the housing 160 is reduced and both of the cartridges 20 are equally forced into the gas inputs 136. This provides for the sealing on both cartridges and the piercing of both cartridges to occur substantially simultaneously. This provides the necessary seal and the piercing function to avoid the use individual gas valves in each of the gas inputs. It is envisioned that the present invention could be embodied with these multiple valves, but the unique design of the preferred embodiment shown here provides a less expensive alternative.

FIGS. 7 through 15 show the detail of the bolt 132. The breech bolt 132 has a main breech bolt body 200 constructed from a fiber impregnated plastic for light weight with a central channel bore 201 for gas exhaust. The composite structure using the fiber impregnate plastic allows the bolt 132 to have a low mass for fast operation inside the marker 100 by lowering the moment inertia of the bolt 132 and increasing the bolt's ability to change direction. The low mass provides a distinct advantage but the high wear characteristics of the plastic used for the bolt 132 creates wear problems for the sear 131 to bolt 132 engagement area. To overcome these problems, the present invention utilizes a precision release insert 206 to form a sear catch edge 204 on the bolt 131. The precision release insert 206 is made from a low wear metal and may be constructed as a rivet or other material that is press fit, glued, welded, directed molded, or otherwise attached into the bolt. Several alternative embodiments may be utilized to for the catch edge 204 including a metal bar across the sear catch edge or even the use of a washer or ring positioned on the circumference of the bolt 132. For the preferred embodiment, a cylindrical insert was constructed to minimize the amount of heavy weight material that is used in the bolt 132 design in order to maintain both the low manufacturing cost and the low weight advantages. The present invention's preferred embodiment uses a cylindrical metal piece for the precision release insert 206 that is basically a cylinder with a rough edge that is molded into the plastic used for the bolt 132 during manufacture. The internal core aperture 207 to bottom edge 211 of the insert 206 provides the catch release edge 204 and allows for the corners of the square shaped retractable sear 131 to ride on the rounded edge of the insert's aperture 207 at only two locations. This provides for reduced friction in the contact between the sear 131 and the insert 206 for easier operation of the retractable sear 131.

A further advantage of the present design is the use of a spring retention tube 209 on a back end 208 of the bolt 132 which defines a sear access slot 210 so that the sear 131 does not drag along the bolt 132 once the sear 131 is released. For the reengagement with the sear 131, the sear access slot 210 has an internal end 212 with a sear retraction ramp 214. This directs the retractable sear 131 onto and over the precision release insert 206. The sear 131 to slot 210 alignment is controlled by a rotational alignment structure 216 that uses a guide extension 218 having a fin 220 that rides in an internal body slot 210 on the marker body 102. For the preferred embodiment, the fin 220 is constructed with a length 222 aligned with a main body axis 224. This allows the fin 220 to slide in the internal body slot 210 to keep the sear 131 aligned with the access slot 210 for engagement with the sear catch edge 204 on the precision release insert.

Reference numerals used throughout the detailed description and the drawings correspond to the following elements:

a paintball 10
gas cartridge/gas container 20
a pressurized gas 22
a gas containment body 24
release neck 26
elongated central compartment 28
domed end 30
a paintball marker apparatus 100
marker body 102
left housing 104
right housing 106
screw 108
grip 110
trigger 112
trigger spring 114
hopper 116
hopper release button 118
barrel 120
cocking pump handle 122
an extended arm 123
safety 124
a launching device 126
hammer compression spring 128
hammer assembly 130
retractable sear 131
bolt assembly 132
valve body assembly 134
gas inputs 136
a gas combination chamber 144
a valve seal 148
seal driving rod 149
a seal biasing spring 150
a release position 151
a releasable chamber seal 154
an expansion volume 156
a combined gas supply 158
a cartridge housing 160
ribs 161
a multiple cartridge holding area 162
a pressure application device 164
a first range of motion 166
a second range of motion 168
a first thread 170
a piercing screw cartridge cap 172
a second thread 174
a multiple cartridge contact area 176
a main breech bolt body 200
a central channel bore 201
a main body 202
a sear catch edge 204
a precision release insert 206
a internal core aperture 207 a back end 208
a spring retention tube 209
a sear access slot 210
a bottom edge 211
an internal end 212
a sear retraction ramp 214
a rotational alignment structure 216
a guide extension 218
a fin 220
a length 222
a main body axis 224

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A breech bolt apparatus for a paintball marker using a retractable sear to engage the breech bolt, the breech bolt comprising:

a main body having a sear catch edge distally positioned from a back end of the main body, the main body defining a sear access slot extending from the back end towards the sear catch edge; and a guide extension outwardly projecting from the main body;

a precision release insert adapted to consistently engage and disengage the retractable sear, the precision release insert constructed from a sear material molded into the main body constructed from a body material, wherein the body material has a lower inertial mass than the sear material to minimize a weight of the breach bolt apparatus.

2. A breech bolt apparatus for a paintball marker using a retractable sear to engage the breech bolt, the breech bolt comprising:

a main body constructed from a first material, the main body defining a sear catch edge formed from a second material, wherein the first material has a lower inertial mass than the second material, the edge distally positioned from a back end of the main body and a rotational alignment structure including a guide fin outwardly projecting from the main body, wherein the rotational control structure is used to control the alignment of the sear catch edge with the retractable sear.

3. The apparatus of claim 2, the sear catch edge comprising:

a precision release insert adapted to consistently engage and disengage the retractable sear, the precision release insert molded into the main body.

4. A breech bolt apparatus for a paintball marker using a retractable sear to engage the breech bolt, the breech bolt comprising:

a main body constructed from a first material, the main body having a sear catch edge distally positioned from a back end of the main body, the sear catch edge including a precision release insert adapted to consistently engage and disengage the retractable sear, the precision release insert constructed from a second material molded into the main body, wherein the first material has a lower inertial mass than the second material.

* * * * *